US009511501B2

(12) United States Patent
Carneiro et al.

(10) Patent No.: US 9,511,501 B2
(45) Date of Patent: Dec. 6, 2016

(54) SHAVING CARTRIDGES HAVING LUBRICATION MEMBERS

(71) Applicant: The Gillette Company, Boston, MA (US)

(72) Inventors: Hubert Francis Carneiro, Revere, MA (US); Matthew Corey Cataudella, Boston, MA (US); Jack Anthony Washington, Quincy, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 14/739,478

(22) Filed: Jun. 15, 2015

(65) Prior Publication Data

US 2015/0273709 A1 Oct. 1, 2015

Related U.S. Application Data

(63) Continuation-in-part of application No. 13/964,382, filed on Aug. 12, 2013, now Pat. No. 9,333,658.

(51) Int. Cl.

| | |
|---|---|
| ***B26B 21/44*** | (2006.01) |
| ***B26B 21/40*** | (2006.01) |
| *B26B 21/16* | (2006.01) |

(52) U.S. Cl.
CPC ..... *B26B 21/443* (2013.01); *B26B 21/4018* (2013.01); *B26B 21/165* (2013.01)

(58) Field of Classification Search
CPC ... B26B 21/443; B26B 21/4018; B26B 21/165
USPC ..... 30/50
See application file for complete search history.

(56) References Cited

U.S. PATENT DOCUMENTS 3,477,127 A * 11/1969 Regan ..... B26B 19/40 15/104.93
4,712,300 A * 12/1987 Hemmeter ..... B26B 21/44 30/41
4,850,106 A * 7/1989 Braun ..... B26B 21/443 30/41
5,063,667 A 11/1991 Jacobson
5,067,238 A * 11/1991 Miller ..... B26B 21/4018 30/34.2
5,113,585 A * 5/1992 Rogers ..... A61K 8/8117 30/41

(Continued)

*Primary Examiner* — Sean Michalski
(74) *Attorney, Agent, or Firm* — John M. Lipchitz; Kevin C. Johnson; Steven W. Miller

(57) ABSTRACT

A shaving blade unit with a housing having a bottom surface and a top surface defining a pair of elongated spaced apart apertures extending from the top surface to the bottom surface. At least one blade is mounted to the housing. The blade has a blade edge extending generally parallel to the pair of apertures. A solid polymeric lubrication member having an upper skin contact surface and an opposing base. A pair protrusions extend from the base. Each protrusion has an enlarged distal end. The enlarged distal ends of the protrusions each have a dimension greater than a dimension of the corresponding aperture whereby inserting the protrusion into the corresponding aperture deflects a front wall of the housing and each of the enlarged distal ends engage the bottom surface of the housing. The solid polymeric lubrication member and the enlarged distal ends are molded from a water soluble polymer.

7 Claims, 3 Drawing Sheets

(56) References Cited

U.S. PATENT DOCUMENTS 5,134,775 A * 8/1992 Althaus ..... B26B 21/44 30/41
5,345,680 A * 9/1994 Vreeland ..... C08L 23/12 30/41
5,388,331 A * 2/1995 Doroodian-Shoja ..... B26B 21/4087 116/208
5,430,939 A * 7/1995 Johnston ..... B26B 21/443 30/41
6,009,624 A * 1/2000 Apprille, Jr. ..... B26B 21/227 30/48
6,145,201 A 11/2000 Andrews
6,185,823 B1 * 2/2001 Brown ..... B26B 21/00 30/50
6,298,558 B1 * 10/2001 Tseng ..... B26B 21/443 30/41
6,568,082 B2 5/2003 Pouettre et al.
6,594,904 B1 * 7/2003 Tseng ..... B26B 21/4087 116/208
7,069,658 B2 * 7/2006 Tseng ..... B26B 21/4087 116/208
7,811,553 B2 10/2010 O'Grady et al.
2006/0254056 A1 11/2006 Coffin et al.
2008/0242739 A1 * 10/2008 Kroon ..... A61K 8/731 514/781
2009/0071007 A1 * 3/2009 Bruno ..... B26B 21/44 30/34.2
2009/0183352 A1 * 7/2009 Metcalf ..... B26B 21/4006 29/428
2010/0291165 A1 * 11/2010 Glenn, Jr. ..... A61K 8/046 424/401
2010/0293789 A1 * 11/2010 Kwiecien ..... B26B 21/443 30/34.05
2012/0000074 A1 1/2012 PazosSchroeder
2012/0023749 A1 2/2012 Ariyanayagam et al.
2012/0094003 A1 * 4/2012 Kwiecien ..... B26B 21/443 427/2.1
2012/0102741 A1 * 5/2012 Pesikov ..... B26B 21/44 30/41
2014/0090254 A1 * 4/2014 Wang ..... B29C 45/00 30/41
2014/0310960 A1 * 10/2014 Ariyanayagam ... B26B 21/4068 30/34.05
2014/0373362 A1 * 12/2014 Bozikis ..... B26B 21/40 30/50
2015/0040402 A1 * 2/2015 Carneiro ..... B26B 21/4018 30/41

* cited by examiner

SHAVING CARTRIDGES HAVING LUBRICATION MEMBERS

FIELD OF THE INVENTION

The present invention relates to shaving razors and more particularly to shaving razor cartridges having a housing and a lubrication member secured to the housing.

BACKGROUND OF THE INVENTION

In general, shaving razors of the wet shave type include a cartridge or blade unit with at least one blade with a cutting edge, which is moved across the surface of the skin being shaved by means of a handle to which the cartridge is attached. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled. Razor cartridges usually include a guard which contacts the skin in front of the blade(s) and a cap for contacting the skin behind the blade(s) during shaving. The cap and guard aid in establishing the so-called "shaving geometry", i.e., the parameters which determine the blade orientation and position relative to the skin during shaving, which in turn have a strong influence on the shaving performance and efficacy of the razor. The guard may be generally rigid, for example formed integrally with a frame or platform structure which provides a support for the blades.

In the use of shaving razors of the wet shave type, factors such as frictional drag of the razor across the skin, force needed to sever hairs, and irritation or pre-existing skin damage can create a degree of shaving discomfort. Shaving aids, e.g., a lubricant, whisker softener, razor cleanser, medicinal agent, cosmetic agent or combination thereof, have been incorporated into razors, for example by incorporating a shaving aid into one or more extruded or molded polymeric components of the razor. Such shaving aid composites may be mounted on the cap or guard structures of the razor cartridge. Upon exposure to water, water-soluble shaving aid leaches from the composite onto the skin and the composite tends to swell.

The shaving aid composites must be positively secured for effective dispensing throughout the useful shaving life of the razor. Forces during shaving may contribute to loosening of the shaving aid components from the cartridge. In addition, consumers may store the wet shaving cartridge on bathroom tub or countertop after shaving. Accordingly, the wet shaving aid components may become stuck to the bathroom tub or countertops. The consumer may then damage the shaving aid or the cartridge when attempting to remove the cartridge from the countertop or bathroom tub. Numerous extruded or molded shaving aid components have been developed which are secured to the shaving razor cartridge with adhesives. These arrangements have been unsatisfactory for certain applications. Adhesives are typically a poor choice for several reasons. Adhesives are difficult to work with from a manufacturing perspective and are also susceptible to changes in heat and humidity.

In certain countries, shaving razors are exposed to constant high levels of heat and humidity during shipment and storage. These levels of heat and humidity can adversely affect the adhesive properties such that the lubrication component is no longer secured. Various press-fit type designs have also been developed to secure the shaving aid component to the cartridge of the shaving razor. The various press-fit type designs have also proven to be ineffective in certain applications. Press-fit designs rely on a significant amount of force to be applied to the shaving aid composite in order to properly secure the shaving aid composite within the housing, which may cause the shaving aid composite to break or fracture. These designs are also not very effective because they do not accommodate for changing forces resulting from the shaving aid composite swelling and expanding. These cartridge designs also rely on an increased surface contact area with the shaving aid composite to better secure the shaving aid composite to the cartridge, which limits the cartridge design, such as the size of the cartridge and the placement of the blade(s).

What is needed, then, is a wet shaving razor cartridge having lubrication member that is secured to the cartridge that accounts for water absorption and swelling without negatively impacting shaving performance or the securement of the lubrication member to the housing. It may also be desirable to provide a manufacturing method for assembling a lubrication member that accounts for tolerance variations without negatively impacting shaving performance. The wet shaving razor cartridge assembly, is preferably simpler, cost-effective, reliable, durable, easier and/or faster to manufacture, and easier and/or faster to assemble with more precision.

SUMMARY OF THE INVENTION

In one aspect, the invention features, in general, a shaving blade unit with a housing having a bottom surface and a top surface defining a pair of elongated spaced apart apertures extending from the top surface to the bottom surface. At least one blade is mounted to the housing. The blade has a blade edge extending generally parallel to the pair of apertures. A solid polymeric lubrication member having an upper skin contact surface and an opposing base. A pair protrusions extend from the base. Each protrusion has an enlarged distal end. The enlarged distal ends of the protrusions each have a dimension greater than a dimension of the corresponding aperture whereby inserting the protrusion into the corresponding aperture deflects a front wall of the housing and each of the enlarged distal ends engage the bottom surface of the housing. The enlarged distal ends of the protrusions are molded from a water soluble polymer. If, desired, particular embodiments may optionally include the solid polymeric lubrication positioned within a pocket defined by the front wall and a pair of internal sidewalls of the housing. Particular embodiments may also optionally include the pocket further defined by an elastomeric member positioned in front of the at least one blade.

In another aspect, the invention features, in general, a shaving blade unit with a housing having a bottom surface and a top surface. At least one blade is mounted to the housing. A solid polymeric lubrication member composed of a water soluble polymer is positioned in front of the blades. The solid polymeric lubrication member has an upper skin contacting surface. An elastomeric member having a plurality of fins is positioned between the at least one blade and the solid polymeric lubrication member. The upper skin contacting surface of the solid polymeric lubrication member has an elongated portion in front of the fins and a pair of lateral ends that extend from the elongated portion toward the at least one blade. If, desired, particular embodiments may optionally include the fins positioned between the pair of lateral ends of the solid polymeric lubrication member. Particular embodiments may also optionally include a pair of clips securing the at least one blade to the housing such that the pair of lateral ends of the solid polymeric lubrication member are immediately adjacent to the clip. The clips may be axially aligned with the pair of lateral ends of the solid polymeric lubrication member.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings.

DETAILED DESCRIPTION OF THE INVENTION

Figure 1:
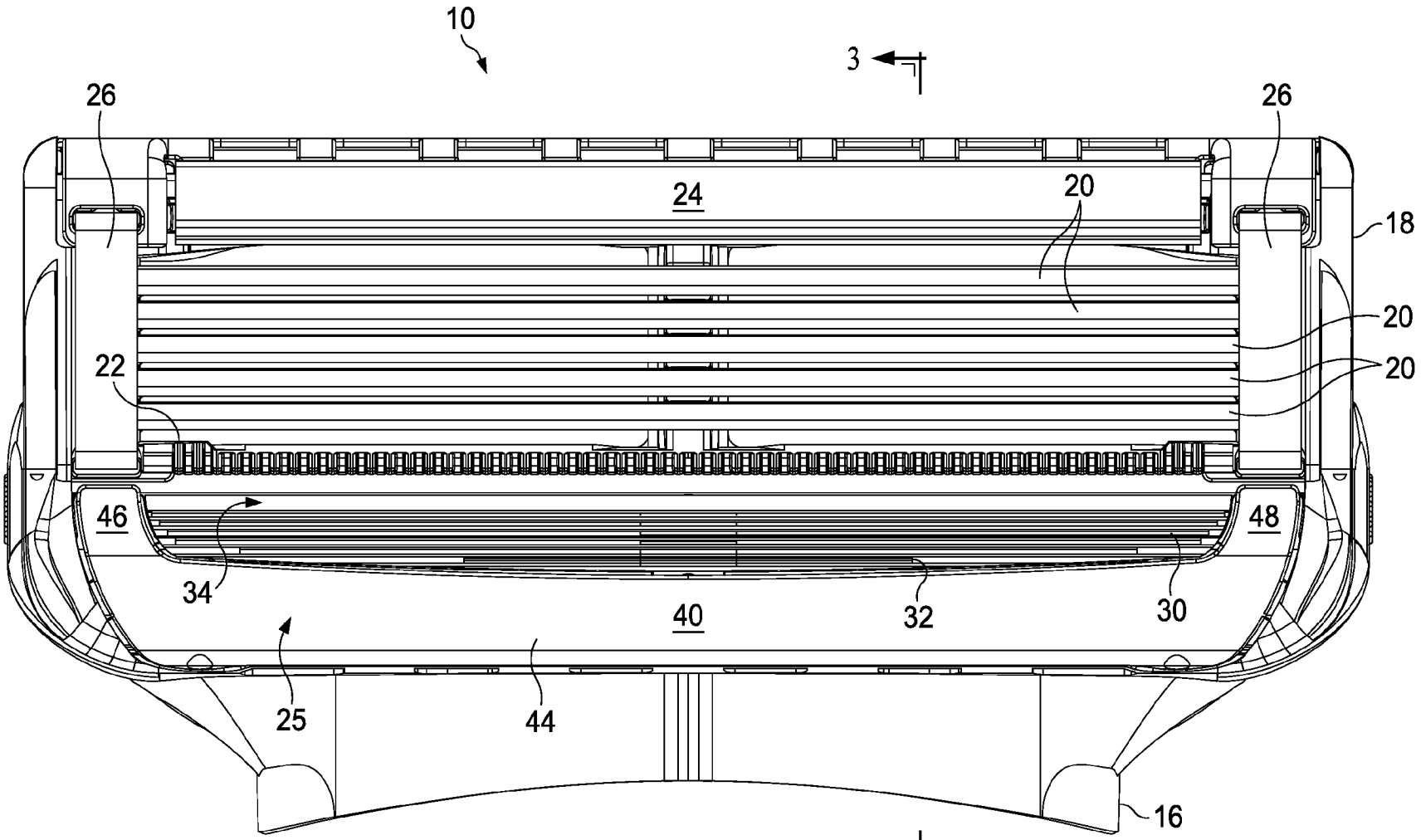
FIG. 1 is top view of one possible embodiment of a shaving blade unit.

Referring to FIG. 1, one possible embodiment of the present disclosure is shown illustrating a shaving blade unit 10. In certain embodiments, the shaving blade unit 10 may be detached and removed from a handle (not shown). The shaving blade unit 10 may be fixedly or pivotably mounted to the handle depending on the overall desired cost and performance. The shaving blade unit 10 may also include an interconnect member 16 to which the shaving blade unit 10 is pivotably mounted about a pivot axis. The shaving blade unit 10 may include a housing 18 that carries one more blades 20, a guard 22, a cap 24, and a solid polymeric lubrication member 25. The one or more blades 20 may be positioned between the guard 22 and the cap 24. Each blade 20 may have a blade edge 21 extending parallel to the cap 24 and the guard 22. The guard 22 and the cap 24 may define a shaving plane. In certain embodiments, an elastomeric member 30 may be mounted to the housing 18 between the guard 22 and the solid polymeric lubrication member 25 (i.e., in front of the guard 22 and behind the solid polymeric lubrication member 25). The guard 22 may be segmented, as shown, or may be a continuous bar.

The solid polymeric lubrication member 25 may be injection molded from a combination of one or more water-soluble polymers (e.g., polyethylene oxides generally known as POLYOX (available from Dow Chemical)) and a non water soluble polymer (e.g., high impact polystyrene). The delivery of lubrication in the form of an injection molded lubricating element has typically involved a three material molded frame in which the lubrication element is molded onto a substrate base (e.g., the Venus Embrace® sold by the Gillette Company). This design and method involves maintaining geometry of the frame as multiple injection molded materials cool at different rates, which causes warping. A single molded lubrication bar (i.e., a unitary member) being assembled into a pre-molded housing provides numerous advantages. For example, this approach allows each element to be optimally controlled during injection molding therefore enabling more consistent geometry which is important for a close, comfortable shave. Injection molding of the solid polymeric lubrication member 25 also allows for a greater variety of shapes (e.g., compared to extruded lubrication bars) and different surface textures to be added. However, the solid polymeric lubrication member 25 must be strongly secured to the housing 18 because swelling of the solid polymeric lubrication member 25 during shaving may cause the solid polymeric lubrication member 25 to separate from the housing 18.

The shape of the solid polymeric lubrication member 25 may have a generally low profile to facilitate mounting to the housing 18, thus enabling the housing 18 to also have a low profile. The solid polymeric lubrication member 25 may have an upper skin contacting surface 40 and an opposing bottom surface (not shown). The upper skin contacting surface 40 may have a generally U-shaped profile to provide improved glide and a more comfortable feel against the skin of the user (e.g., compared to an extruded lubrication strip). The upper skin contacting surface 40 may have an elongated portion 44 in front of the elastomeric member 30. The elongated portion 44 may extend parallel to the at least one blade 20. A pair of lateral ends 46, 48 may extend from the elongated portion 44 toward the at least one blade 20. The pair of lateral end 46,48 may extend transverse to the at least one blade 20 and/or the elongated portion 44 of the upper skin contacting surface 40. In certain embodiments, upper skin contacting surface 40 may be smooth. However, other embodiments might include the use text, texture, pattern, lines, icons, or channels to promote a particular aesthetic or functional benefit, for example, skin stretching of tactile feel on the skin.

The one or more blades 20 may be mounted within the housing 18 and secured with one or more clips 26. The clips 26 may be parallel to each other and may extend into the housing to secure the blades to the housing. Other assembly methods known to those skilled in the art may also be used to secure the one or more blades 20 to the housing 18 including, but not limited to wire wrapping, cold forming, hot staking, insert molding, and adhesives. The combination of the solid polymeric lubrication member 25 and the clips 26 may improve the glide of the shaving blade unit 10 against the skin during a shaving stroke. The lateral ends 46, 48 of the solid polymeric lubrication member 25 may be positioned directly in front of (e.g., immediately adjacent) the clips 26. Accordingly, glide may be enhanced because lubricants released from the solid polymeric lubrication member 25 may be deposited directly onto the metallic clips 26 during a shaving stroke. The respective clips 26 may be spaced apart from the lateral ends 46, 48 during assembly to allow the solid polymeric lubrication member 25 to absorb water and swell during use. As the solid polymeric lubrication member 25 swells, the lateral ends may contact the clips 26. The clips 26 may be axially aligned with the lateral ends to improve the amount of lubrication deposited onto the clips 26.

In certain embodiments, the elastomeric member 30 having a plurality of fins 32 between the at least one blade and the solid polymeric lubrication member 25 to stretch the skin for proving a closer shave. The fins 32 may extend generally parallel to the at least one blade 20 and/or the elongated portion 44 of the upper skin contacting surface 40 on the solid polymeric lubrication member 25. The elastomeric member 30 may be positioned between the lateral ends lateral end 46,48 to provide a sufficient amount of glide (e.g., lubrication) and skin stretching. For example, the shaving blade unit 10 may provide more glide toward the sides of the housing 18 and increased skin stretch in front of the blades 20 (i.e., toward the middle of the housing 18) while still providing lubrication in front of the blades 20. Accordingly, the consumer may experience increased comfort from the lubrication without sacrificing the close shave achieved by sufficient skin stretching in front of the blades 20. In certain embodiments, the elastomeric member 30 may directly contact the solid polymeric lubrication member 25 (e.g., during assembly or during a shaving stroke as the solid polymeric lubrication member 25 absorbs water and swells). The close spacing of the elastomeric member 30 and the solid polymeric lubrication member 25 may facilitate more lubricants to be deposited onto the elastomeric member 30. In certain embodiments, an elongated gap 34 may be positioned between the guard 22 and the elastomeric member 30 (e.g., one of the fins 32).

In certain embodiments, the housing 18 may be molded from Noryl™ (a blend of polyphenylene oxide (PPO) and polystyrene developed by General Electric Plastics, now SABIC Innovative Plastics). The housing 18 may be molded from other semi-rigid polymers having a Shore A hardness of about 50, 60, or 70 to about 90, 110, or 120. The solid polymeric lubrication member 25 may be a separate molded component that is mounted to the housing 18. The solid polymeric lubrication member 25 may be molded from a lubricious shaving aid composite that has one or more water-leachable shaving aid materials to provide increased comfort during shaving. The shaving aid composite may include one or more skin lubricating water-soluble polymers such as, polyethylene oxide, polyvinyl pyrrolidone, polyacrylamide, hydroxypropyl cellulose, polyvinyl imidazoline, and polyhydroxyethylmethacrylate. Other water-soluble polymers may include the polyethylene oxides generally known as POLYOX (available from Dow Chemical) or ALKOX (available from Meisei Chemical Works, Kyota, Japan). These polyethylene oxides may have molecular weights of about 100,000 to 6 million, for example, about 300,000 to 5 million. The polyethylene oxide may comprises a blend of about 40 to 80% of polyethylene oxide having an average molecular weight of about 5 million (e.g., POLYOX COAGULANT) and about 60 to 20% of polyethylene oxide having an average molecular weight of about 300,000 (e.g., POLYOX WSR-N-750). The polyethylene oxide blend may also contain up to about 10% by weight of a low molecular weight (i.e., MW<10,000) polyethylene glycol such as PEG-100.

The shaving aid composite may also optionally include an inclusion complex of a skin-soothing agent with a cylcodextrin, low molecular weight water-soluble release enhancing agents such as polyethylene glycol (e.g., 1-10% by weight), water-swellable release enhancing agents such as cross-linked polyacrylics (e.g., 2-7% by weight), colorants, antioxidants, preservatives, microbicidal agents, beard softeners, astringents, depilatories, medicinal agents, conditioning agents, moisturizers, cooling agents, etc.

Figure 2:
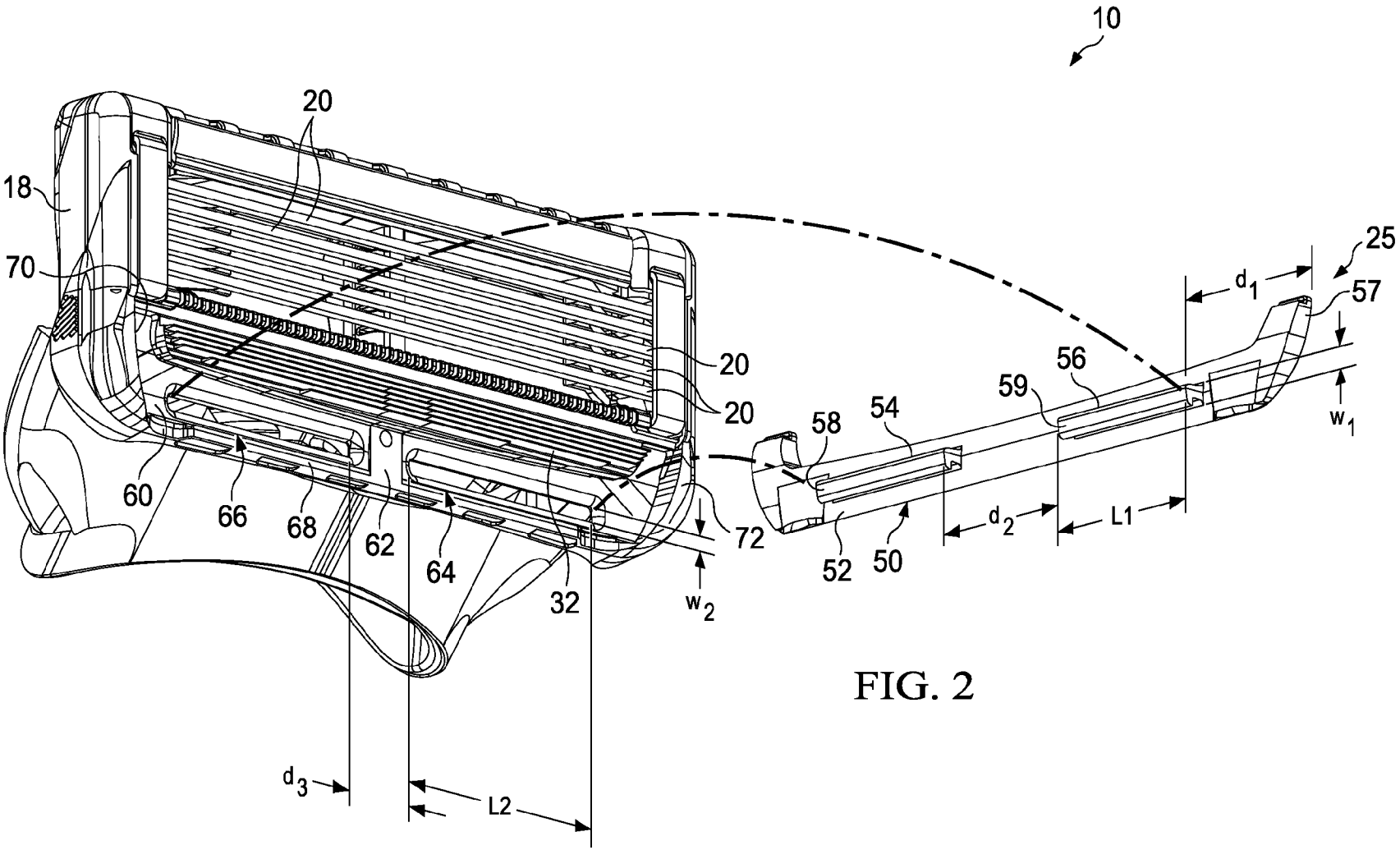
FIG. 2 is an assembly perspective view of the shaving blade unit of FIG. 1.

Referring to FIG. 2, a perspective assembly view of the shaving blade unit 10 is shown illustrating the assembly of the solid polymeric lubrication member 25 to the housing 18. The solid polymeric lubrication member 25 may include a base 50 having a bottom surface 52. The bottom surface 52 of the solid polymeric lubrication member 25 (e.g., the base 50) may have at least one protrusion 54, 56 having a length "L1". In certain embodiments, the solid polymeric lubrication member 25 may have two spaced apart protrusions 54, 56. The length of one or more of the protrusions 54, 56 may be greater than the distance "d1" from the respective protrusion 56 to a lateral edge 57 of the solid polymeric lubrication member 25 to improve securement to the housing 18. The protrusions 54, 56 may be spaced apart by a distance "d2" that is less than the length "L1" of at least one of the protrusions. The protrusions 54, 56 may each have an enlarged distal end 58, 59 to secure the solid polymeric lubrication member 25 to the housing 18. The length of the enlarged distal ends 58, 59 may correspond to the overall length L1 of the corresponding protrusion 54, 56. The enlarged distal ends 58, 59 may each have a width "w1" (measured in a direction transverse to the blades) that is less than the length L1. For example, w1 may be about 0.75 mm, 0.85 mm, or 1.0 mm to about 1.1 mm, 1.2 mm, or 1.3 mm. The dimensions and spacing of the protrusions 54, 56 and the enlarged distal ends 58, 59 may help prevent the solid polymeric lubrication member 25 from separating from the housing 18 as the solid polymeric lubrication member 25 absorbs water and swells. For example, the absorption of water may cause the lateral end 57 to peel away from the housing.

The housing 18 may have a top surface 60 that defines a pocket 62 The top surface 60 of the housing 18 may also define least one aperture 64, 66 positioned within the pocket 62 between a front wall 68 of the housing 18 and the elastomeric member 30. For example, the top surface 60 may define two spaced apart apertures 64, 66 that extend parallel to the fins 32 and/or the at least one blade 20 and are positioned in front of the elastomeric member 30. The apertures 64, 66 may extend from the top surface 60 to a bottom surface of the housing (not shown). As will be explained in greater detail below, the apertures 64, 66 may be dimensioned to receive one of the corresponding protrusions 54, 56. The apertures 64, 66 may each have a length "L2" (i.e., measured parallel to the blade(s) 20) that is greater than its width "w2". For example, L2 may be about 10 mm, 11 mm or 12 mm to about 13 mm, 14 mm or 15 mm. In certain embodiments, w2 may be about 0.75 mm, 0.85 mm, or 1.0 mm to about 1.1 mm, 1.2 mm, or 1.3 mm. The apertures 64, 66 and/or the enlarged distal ends 58, 59 may have a length to width ratio that is greater that 2:1 to improve the security of the solid polymeric lubrication member 25 to the housing 18. In certain embodiments, L2 may be greater than the length of the respective protrusions 54, 56 and/or the respective enlarged distal ends 58, 59 by about 15% to about 40%. The relationship between the length of the apertures 64,66 and the length of the enlarged distal ends 58, 59 can impact alignment during assembly and the amount of force required to deflect the front wall 68 of the housing, which may influence high speed assembly. For example, if the length of the enlarged distal ends 58, 59 are too similar to the length of the respective apertures 64, 66, the enlarged distal ends 58, 59 may not align properly within the aperture 64,66 or the assembly force may be too great, thus damaging the enlarged distal ends 58, 59. The apertures 64, 66 may be spaced apart by a distance "d3" to improve rigidity of the housing 18 and prevent the solid polymeric lubrication member 25 from distorting the housing 18 as the solid polymeric lubrication member 25 swells. For example, a single elongated slot may cause the housing 18 to be too flexible and the solid polymeric lubrication member 25 may become disengage during use.

Figure 3:
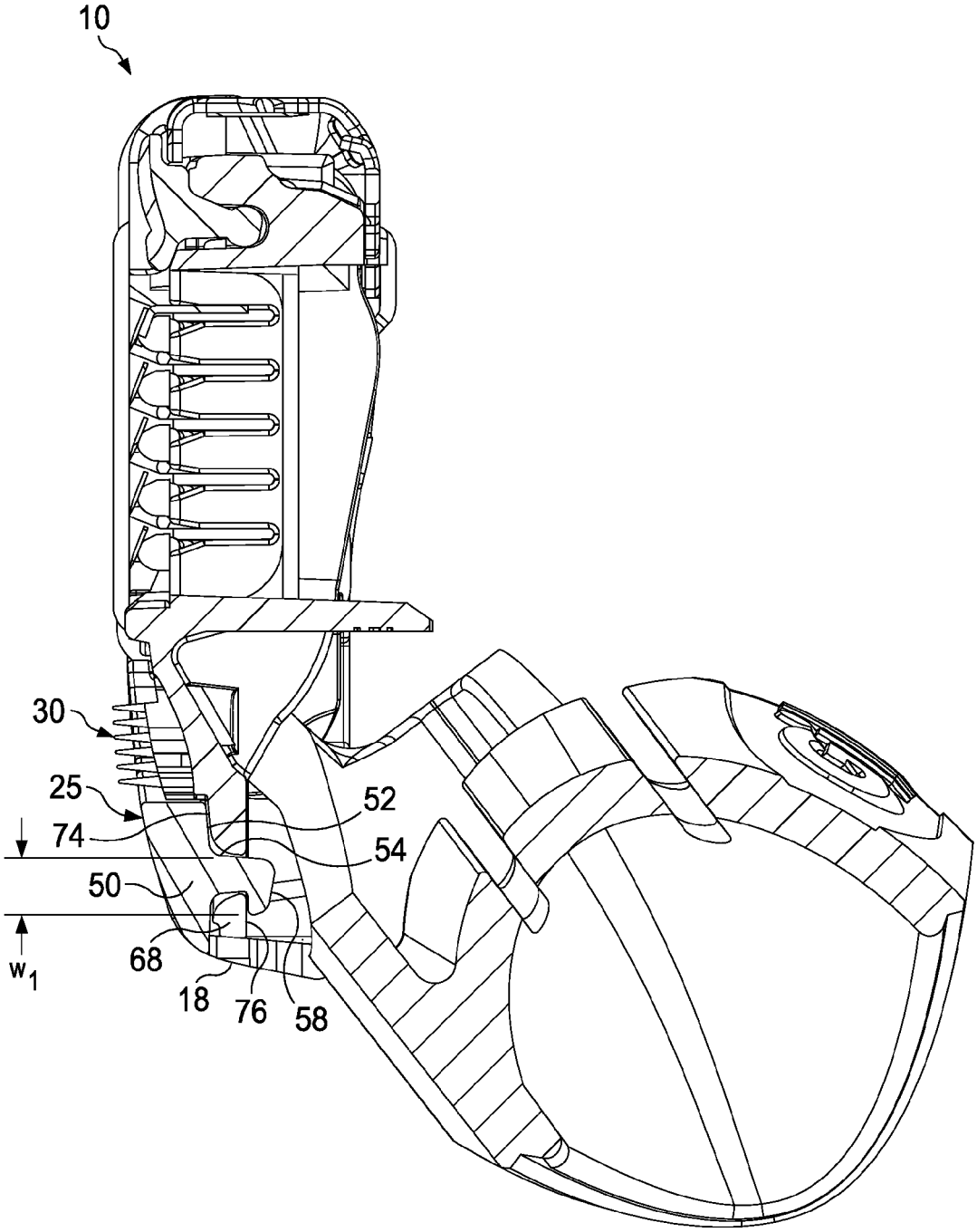
FIG. 3 is a cross section view of the shaving blade unit, taken generally along the line 3-3 of FIG. 1.

Now with additional reference to FIG. 3, the attachment of the solid polymeric lubrication member 25 to the housing 18 will be explained in greater detail. FIG. 3 illustrates a cross section view of the shaving blade unit 10, taken generally along the line 3-3 of FIG. 1. The solid polymeric lubrication member 25 may be attached to the housing 18 such that the base 50 of the solid polymeric lubrication member 25 is generally disposed within the pocket 62. The shape of the pocket 62 may generally correspond to the shape of the solid polymeric lubrication member 25. For example, a pair of sidewalls 70, 72 and the front wall 68 of the housing 18 and the elastomeric member 30 (e.g., a front wall 68 or the fins 32 of the elastomeric member 30) may surround the solid polymeric lubrication member 25. According, the housing 18 may help contain the solid polymeric lubrication member 25 as the solid polymeric lubrication member 25 absorbs water and swells during shaving.

The solid polymeric lubrication member 25 may be pressed into the pocket 62. One or more of the protrusions 54,56 may be pressed into one or more of the corresponding apertures 64, 66 of the housing 18 with corresponding angles of the enlarged distal end(s) 58, 59 of the protrusion(s) 54, 56 and the aperture(s) 64, 66 of the housing 18 facilitating the front wall 68 of the housing to deform. The front wall 68 of the housing 18 may also be flexible to allow for some expansion caused by the absorption of water and swelling of the solid polymeric lubrication member. The enlarge distal end(s) 58, 59 may pass through the corresponding aperture 64,66 and engage a bottom surface 76 of the housing 18 to secure the solid polymeric lubrication member 25 in place such that the bottom surface 52 of the solid polymeric lubrication member 25 maintains contact with a flat seat surface 74 of the housing 18. The enlarged distal ends 58, 59 are exposed to water because they engage the bottom surface 76 of the housing 18. The solid polymeric lubrication member 25 and the enlarged distal ends 58, 59 are molded from a water soluble polymer, as previously described. Accordingly, the enlarged distal ends absorb more water and swell to increase the force required to remove the solid polymeric lubrication member 25 from the housing 18. As shown in FIG. 3, the solid polymeric lubrication member 25 may have a forward leading edge with a gradual slope. A gradual slop may be an advantage compared to typical straight lubrication bars because it may facilitate skin flow over the solid polymeric lubrication member 25 while simultaneously reducing skin drag.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention.

It is therefore intended to cover in the appended claims all such changes and modifications that are within the scope of this invention.

What is claimed is:

1. A shaving blade unit comprising:

a housing having a bottom surface and a top surface, the housing having a guard and a cap;

at least one blade mounted to the housing between the guard and the cap;

a solid polymeric lubrication member comprising a water soluble polymer in front of the blades, the solid polymeric lubrication member having an upper skin contact surface;

an elastomeric member having a plurality of fins between the at least one blade and the solid polymeric lubrication member, wherein the upper skin contact surface of the solid polymeric lubrication member has an elongated portion in front of the fins and a pair of lateral ends that extend from the elongated portion toward the at least one blade; and a pair of clips securing the at least one blade to the housing wherein the pair of lateral ends of the solid polymeric lubrication member are positioned directly in front of and immediately adjacent to the respective clips.

2. The shaving blade unit of claim 1 wherein the fins are positioned between the pair of lateral ends of the solid polymeric lubrication member.

3. The shaving blade unit of claim 1 wherein the clips are axially aligned with the pair of lateral ends of the solid polymeric lubrication member.

4. The shaving blade unit of claim 1 wherein the clip is spaced apart from the pair of lateral ends of solid polymeric lubrication member.

5. The shaving blade unit of claim 1 wherein the clip is metallic.

6. The shaving blade unit of claim 1 wherein the fins extend parallel to the at least one blade.

7. The shaving blade unit of claim 1 wherein the guard is spaced apart from the solid polymeric lubrication member defining an elongated gap.

* * * * *